United States Patent [19]

Brent

[11] Patent Number: 4,569,449

[45] Date of Patent: Feb. 11, 1986

[54] ATTACHMENT DEVICE FOR ATTACHING A PAINT CAN AND BRUSH HOLDER TO A LADDER

[76] Inventor: William E. Brent, One Forest Hill Dr., Taylors, S.C. 29687

[21] Appl. No.: 577,055

[22] Filed: Feb. 6, 1984

[51] Int. Cl.[4] ..... A47F 5/00

[52] U.S. Cl. ..... 211/86; 248/210; 182/129

[58] Field of Search ..... 211/86; 248/210, 211, 248/238, 226.4, 231.7, 231.4, 231.6; 182/129, 106

[56] References Cited

U.S. PATENT DOCUMENTS

| | | | |
|---|---|---|---|
| 881,054 | 3/1908 | Carle, Jr. | 248/210 |
| 1,255,696 | 2/1918 | Bochard | 248/210 |
| 1,358,277 | 11/1920 | Bochard | 248/210 |
| 2,162,022 | 6/1939 | Mansfield | 248/210 |
| 2,308,180 | 1/1943 | Larsen | 182/129 X |
| 2,367,256 | 1/1945 | Atkins | 248/210 |
| 3,182,749 | 5/1965 | Girardello | 248/238 X |
| 4,418,793 | 12/1983 | Brent | 248/238 X |

FOREIGN PATENT DOCUMENTS

| | | | |
|---|---|---|---|
| 2034795 | 6/1980 | United Kingdom | 248/238 |

*Primary Examiner*—Ramon S. Britts
*Assistant Examiner*—Sarah A. Lechok Eley
*Attorney, Agent, or Firm*—Cort Flint

[57] ABSTRACT

An attachment device (A) for attachment to a ladder is disclosed for holding a paint can and brush holder (C) in a generally level condition relative to the ladder. The attachment device includes a clamping post (B) having a first clamping means (14) and a second clamping means (16) affixed to the clamping post. The first and second clamping members have fixed jaws (18) and (20) which are offset relative to each other so that when the clamping post is clamped to an inwardly slanted leg (30) of a ladder, the clamping post (B) is held in a generally vertical position relative to the slanted ladder leg. The paint can and brush holder includes a box (48) which may hold either a single paint can or a number of individual smaller cans. A paint brush holder (54) is affixed to the paint can holder by means of an abutment (52) and tensioning spring (56) which encircles the container to hold it against the box.

16 Claims, 7 Drawing Figures

ATTACHMENT DEVICE FOR ATTACHING A PAINT CAN AND BRUSH HOLDER TO A LADDER

BACKGROUND OF THE INVENTION

The invention relates to a device for holding a paint can and brush when utilizing a ladder. The device attaches to the ladder and can be used with the ladder as a stand or when the painter is on the ladder.

Heretofore, paint can and brush holders have been proposed for use by a painter which attaches to a ladder such as shown in U.S. Pat. Nos. 2,837,306, 4,036,463, 1,243,732, 4,386,375, 2,883,134, and 2,544,312. Numerous arrangements are shown in the above said patents for holding a paint can and several of the above said patents also disclose combination paint can and paint brush holders. In this respect, see U.S. Pat. No. 4,036,463.

While all of these patents disclose numerous arrangements for attaching a paint can holder to a ladder, they also require that the paint can be held generally close to the ladder leg and in a position along the length of the ladder leg which is generally not suitable when the painter is standing on the ladder, particularly, when at the upper steps of the ladder. In this position, the painter must bend to reach the paint can held by the holder.

While the above said patents disclose various arrangements for holding the paint can in a level position such as a free pivoting arrangement, none of the above are suitable for holding and supporting a paint can away from the ladder in a generally level position as would be convenient for the painter when he is positioned on or atop the ladder.

Accordingly, an important object of the present invention is to provide a device for attachment to a ladder for holding a paint can and brush in a stable level condition on a ladder.

Still another important object of the present invention is to provide a paint can holder for attachment to a ladder which cannot be knocked off or accidentally pivoted.

Still another important object of the present invention is to provide a paint can holder for attachment to a ladder in a number of level positions which holds a disposable paint brush holder which may be conveniently removed and disposed.

Still another important object of the present invention is to provide a paint can and brush holder which can be attached to a ladder in a number of stable level positions which attaches to the ladder in a positive manner so that the ladder with the paint can holder attached can be moved and repositioned.

Yet another important object of the present invention is to provide a paint can holder for attachment to a ladder in which the paint can held thereby is positioned away from the ladder sufficiently that a painter has complete freedom of movement and is far enough away from the paint can that accidental contact with the paint such as on the painter's clothing is avoided.

SUMMARY OF THE INVENTION

The above objectives are accomplished according to the present invention by providing an elongated post having a pair of offset clamps which clamp the post to one of the inwardly slanted legs of a ladder while the post is oriented in a generally vertical position. An angled arm extending away from the elongated post includes a bracket on a free end of the arm for attachment to a paint can holder. With the elongated post clamped by means of the offset clamps the entire assembly is held in a generally level position. The angled arm holds the paint can holder away from the ladder and close to the area for painting. An abutment carried by the paint can holder holds a disposable container for holding the paint brush. A releasable fastener encircles the paint brush container so that it may be easily removed and disposed of. A removable bracket fits with the opposite end of the elongated post so that the elongated post may be turned upside down and used on the other side of the ladder with the angle arm disposed in an out of the way position for use when the ladder is leaning against the wall.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
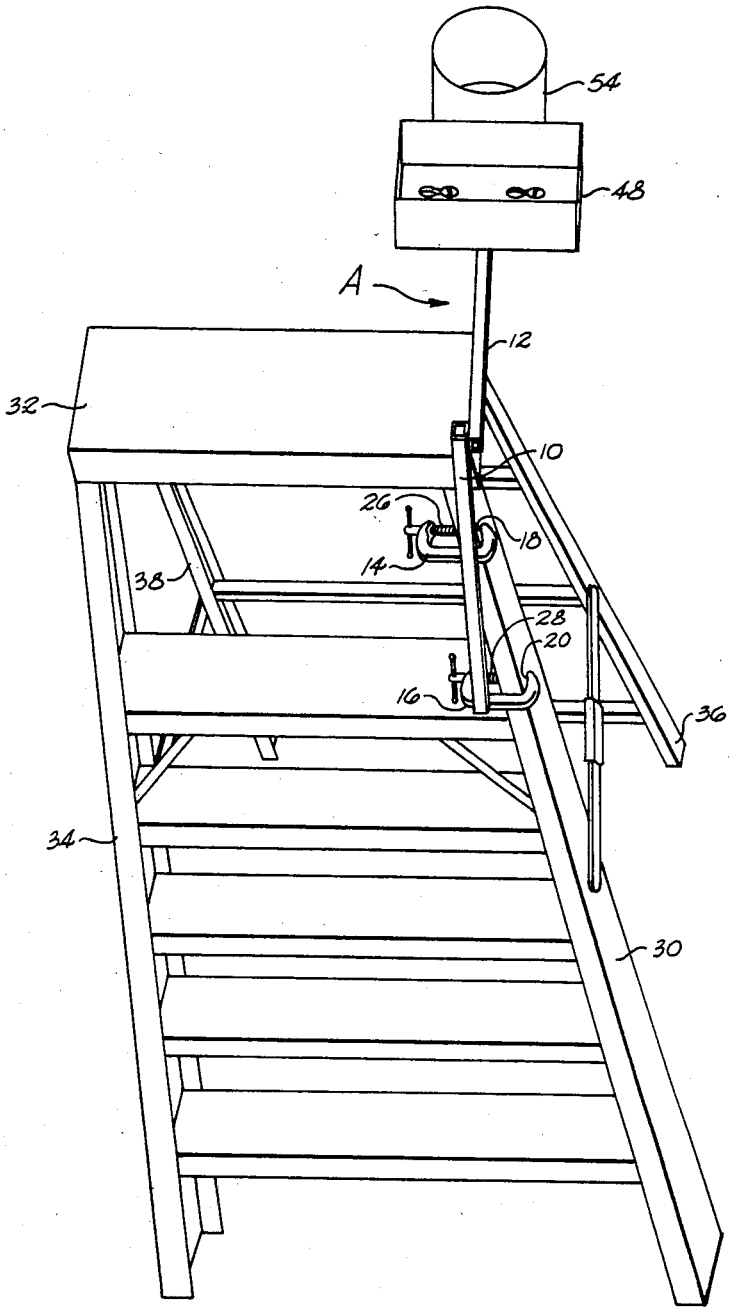
FIG. 1 is a perspective view illustrating an attachment device for attaching a paint can and brush holder to a ladder according to the present invention.
Figure 2:
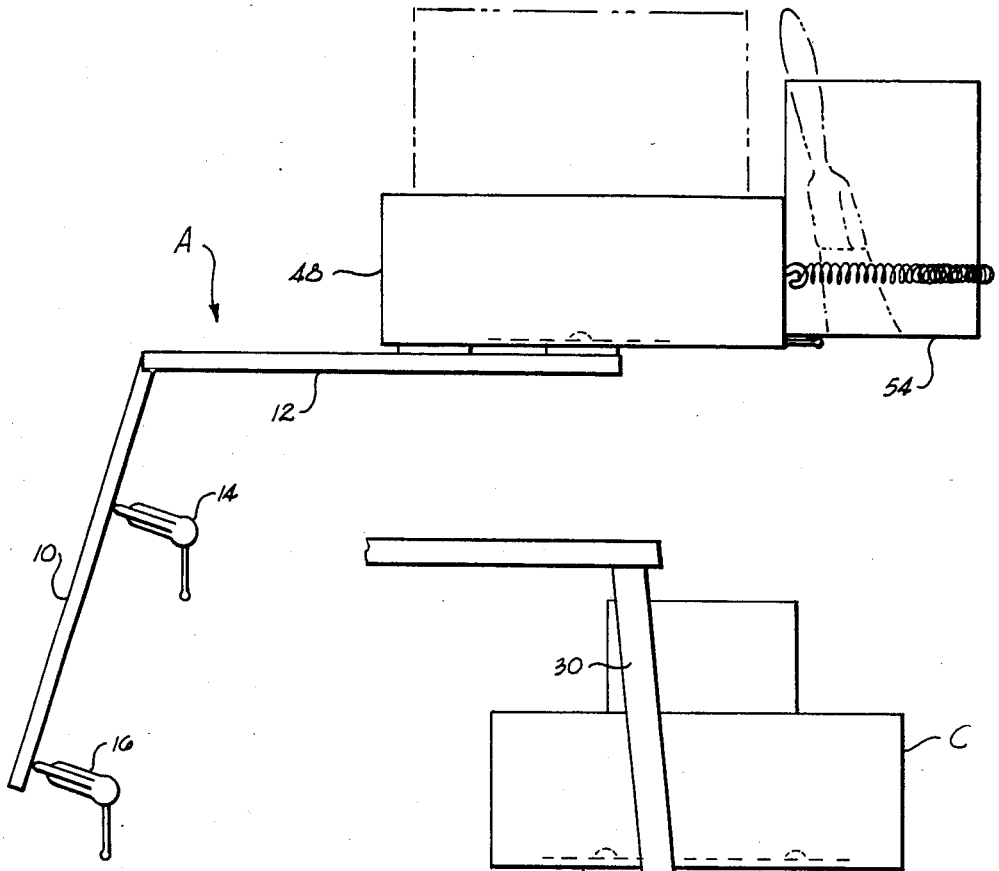
FIG. 2 is an elevation illustrating a device for attachment to a ladder according to the invention for holding a paint can and paint brush.

Referring now in more detail to the drawings, there is illustrated an attachment device designated generally as A which includes an elongated post B and an angled arm carried adjacent one end of the post. A bracket is carried adjacent the angle arm for attaching a paint can and brush holder C. Offset clamping means D is disclosed which includes a pair of spaced offset clamps attached to the post B. A first clamp includes a first clamping jaw and the clamping jaw of the second clamp is offset with respect to the first clamping jaw so that when the post is clamped to an inwardly slanted leg of the ladder, the post is held in a generally upright position.

Referring now in more detail to the drawings, the elongated post B is illustrated as a hollow rectangular tubular member 10. There is an angle arm 12 carried at one end of the tubular elongated post 10.

The offset clamping means D includes a first C-clamp 14 attached to the tubular post 10 by any suitable means such as welding and a second C-clamp member 16 spaced from the C-clamp 14. The C-clamp 16 is also fixed to the tubular post 10 such as by welding. The first clamp 14 includes a first, fixed offset clamping jaw 18. The clamp 16 includes a second, fixed offset clamping jaw 20 which is offset relative to the clamping jaw 18 of the first clamp member 14. In the illustrated embodiment this is accomplished by affixing clamps 14 and 16 at different lateral positions relative to the tubular post 10. In this offset position, the movable clamping faces 22 and 24 respectively of the screws 26 and 28 of the clamping members clamp an inwardly slanted leg 30 of a ladder 32 against the fixed offset clamps.

Figure 3:
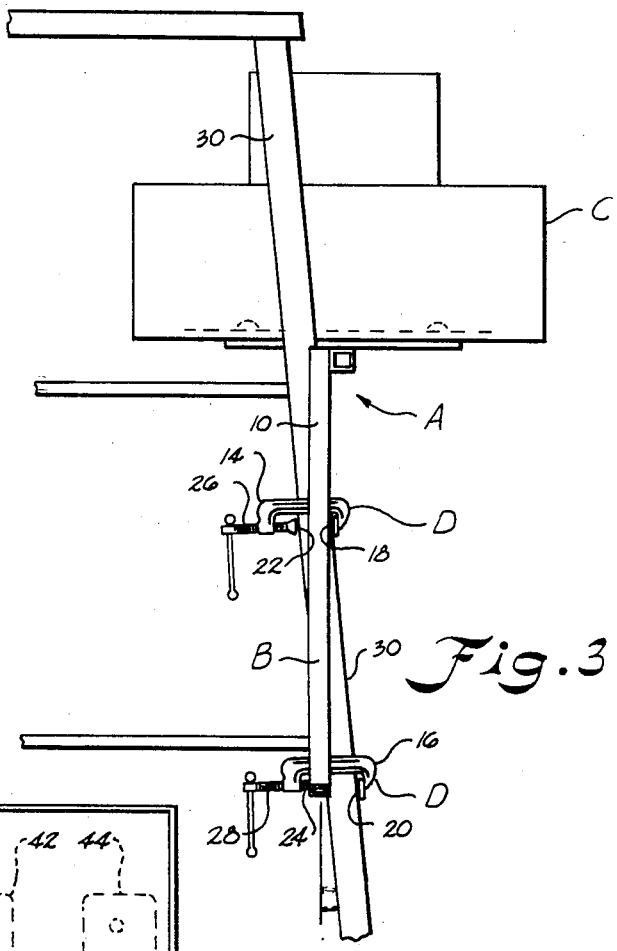
FIG. 3 is an elevation illustrating an attachment device for attachment to a ladder for supporting a paint can and brush according to the invention.
Figure 4:
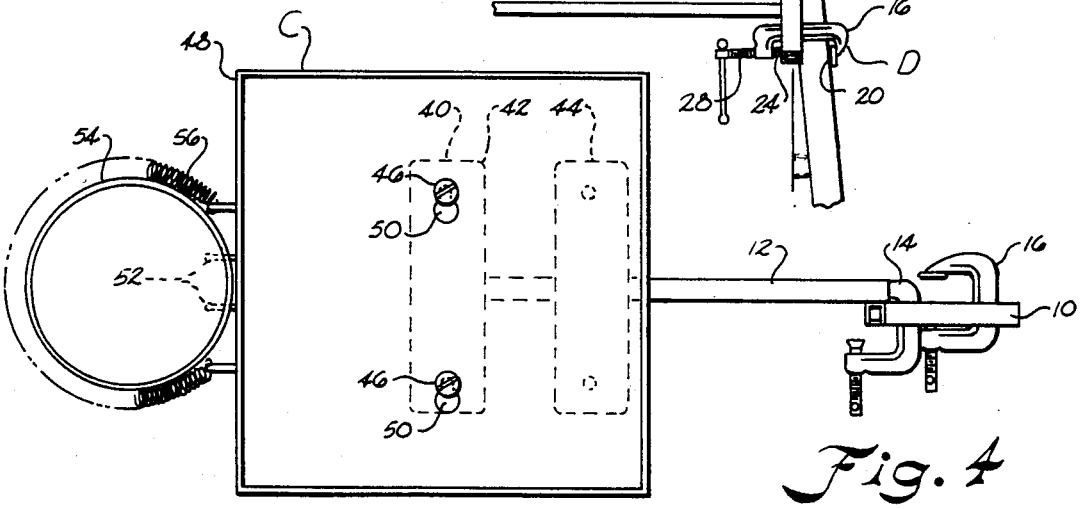
FIG. 4 is a top plan view of the device of FIG. 3.

In a conventional stepladder, front legs 30 and 34 are slanted inwardly toward one another and also rearwardly to the back legs 36 and 38. By offsetting the clamps 18 and 20 relative to the tubular post 10, as can best be seen in FIGS. 3 and 4, the tubular post may be clamped thereby to the leg 30 such that the elongated post 10 is generally upright and vertical. Accordingly, the angle arm 12 which extends outwardly from the tubular post 10 is also level for supporting the paint can and brush holder C.

At the free end of the angled arm 12 is a first bracket member 40 which includes a pair of spaced plates 42 and 44. A pair of threaded bolts 46 are carried by the plate 42. The bolts 46 may also be placed in threaded holes formed in the back plate 44 as required to mount a desired paint holder.

The paint can holder C includes a square box which includes a pair of key-slots 48 in the bottom which cooperate with the bolts 46 to lock the box on the bracket means 40.

It is also to be understood of course, that another suitable paint container such as a paint roller tray may be attached to the bracket means and that suitable bracket means may be so provided.

There is an abutment means carried by the box 48 in the form of a pair of spaced pins 52 which support a container 54 around which a releasable fastening member 56 is encircled to secure the container 54 to box 48. Any suitable container may be secured by the releasable fastener 56. Preferably, a two and one-half pound coffee can is utilized which has indented ribs formed in the can spaced vertically along the height of the can. The releasable fastener 46 then fits in these ribs. In the preferred form, the releasable fastener 56 is a spring, such as a door closure spring, having its ends secured to the box 48 by any suitable means.

Thus, it can be seen that an advantageous construction for a ladder attachment device for holding a paint can and brush which can be moved to any position along the height of a ladder and extends away therefrom to be conveniently reached by the painter when on the ladder, particularly atop the ladder.

Figure 5:
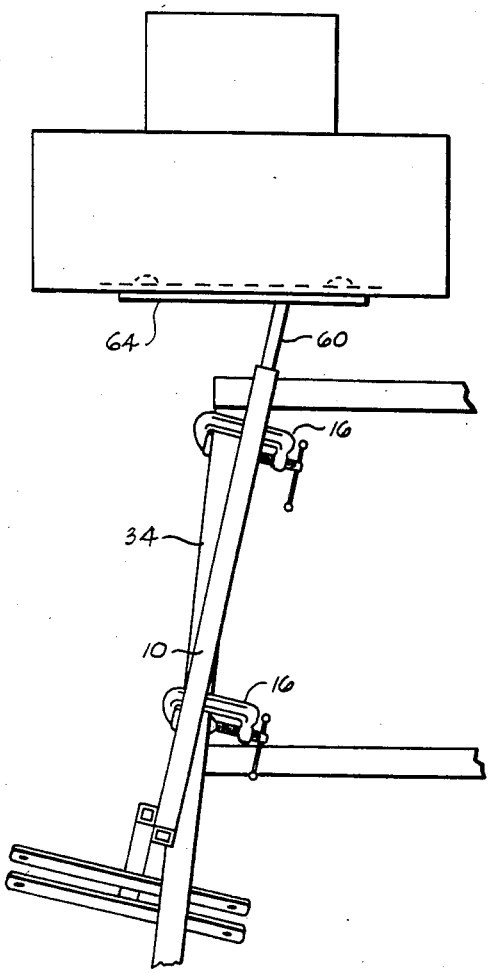
FIG. 5 is an elevation illustrating the attachment device for attaching a paint can and brush holder to a ladder according to an alternate arrangement of the invention.
Figure 6:
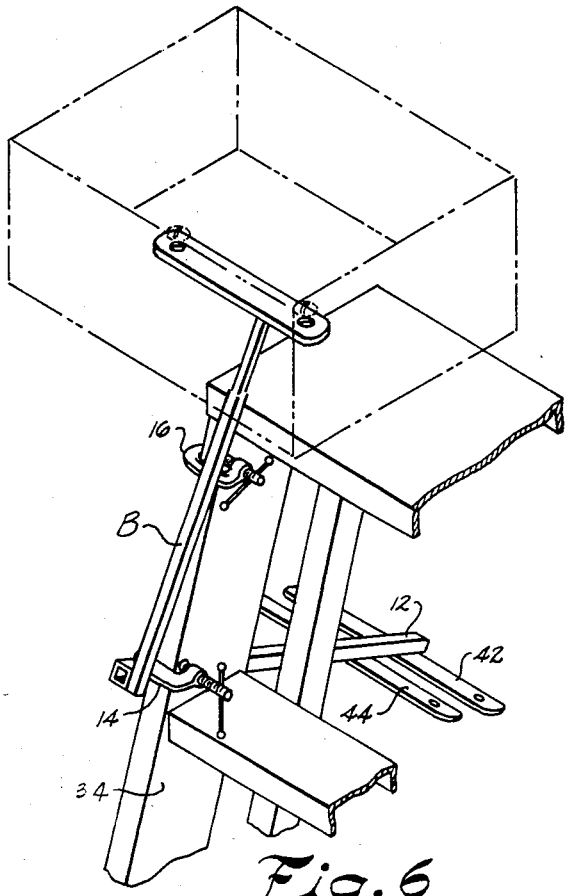
FIG. 6 is a perspective view illustrating an attachment device for attaching a paint can and brush holder to a ladder with the attachment device being inverted for attachment to a ladder leaning against a wall.
Figure 7:
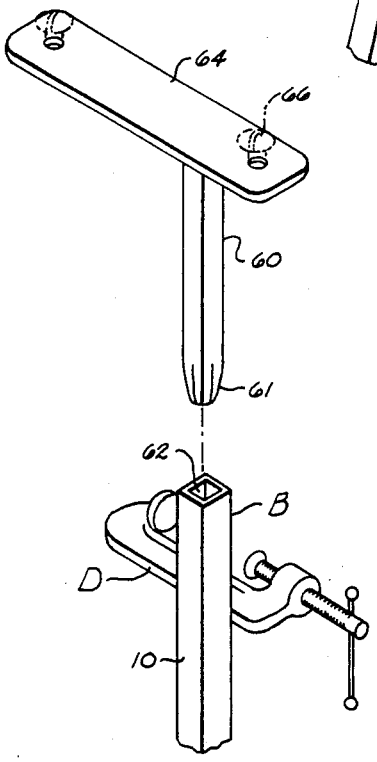
FIG. 7 is a perspective view illustrating a removable fitting utilized for supporting a paint can and brush holder according to the invention with an inverted clamping post.

Referring now to FIGS. 5–7, an alternate arrangement is shown wherein clamping post 10 is utilized in an inverted position on ladder leg 34. A removable fitting 60 is illustrated having a square tapered shank 61 which fits in a hollow end 62 of the tubular post 10. The fitting 60 includes a second bracket means 64 in the form of a plate having a pair of threaded bolts 66 which interlock with the key-way slots 50 of the paint containing box 48.

The tubular post 10 may be inverted and attached to the ladder leg 34. In this position, the angle arm 12 is tucked downwardly and inwardly and out of the way should the ladder be leaned against a wall. In this position, the fitting 60 inserted into the end 62 provides a means by which the attachment device may hold the paint can holder box 48 with the ladder leaned against the wall. Bracket plate 64 is angled with respect to fitting shaft 60 so that the box 48 is level.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit or scope of the invention herein disclosed.

What is claimed is:

1. An attachment device for attachment to a ladder for holding a paint can and brush in a generally level condition relative to the ladder wherein the ladder is of the type having a pair of front legs which are slanted inwardly towards one another between which are carried ladder steps, said device comprising:

an elongated clamping post for supporting a paint can and brush holder;

a first bracket means carried adjacent an end of said elongated post for attaching said paint can and brush holder;

a first clamping means carried by said elongated clamping post for clamping to a leg of said ladder having a fixed clamping jaw;

a second clamping means affixed to said elongated post for clamping to said leg of said ladder, said second clamping means having a fixed clamping jaw which is laterally offset to said first clamping jaw of said first clamping means relative to said clamping post;

said first and second clamping means clamping to said leg of said ladder by means of said offset clamping jaws so that said elongated post means is clamped in a generally vertical position relative to said inwardly slanted leg of said ladder for supporting said paint can and brush holder.

2. The device of claim 1 including:

a paint can holder having attachment means for attachment to said first bracket means;

a paint brush holder carried by said paint can holder;

a horizontal support carried by said paint can holder for supporting a paint brush holder; and a releasable fastener for fastening and securing said paint brush holder to said paint can holder while supported on said horizontal support.

3. The device of claim 1 including a generally horizontal arm carried by said clamping post which extends away from said ladder when said elongated post is clamped to said ladder leg.

4. The apparatus of claim 3 wherein said bracket means is carried adjacent a free end of said horizontal arm for supporting said paint can holder and paint brush holder thereon.

5. The device of claim 1 including:

said elongated clamping post having a free end;

an insert fitting with said free end of said elongated post member;

a second bracket means carried by said insert shaft for supporting said paint can holder and brush holder; and said clamping means carried by said elongated post so as to clamp said elongated post to said ladder leg in an inverted position so that said insert shaft may be fitted to said free end of said clamping post member for supporting said paint can and brush holder.

6. The device of claim 5 wherein said insertable fitting includes a rectangular shaft having a rectangular cross-section corresponding to the cross-section of said hollow post, said shaft fitting within said post so that said shaft does not turn in said elongated post when fitted therein and supporting said paint can and brush holder.

7. The device of claim 2 wherein said releasable fastener includes a spring having a pair of ends fixed to said paint can holder so that said releasable fastener spring may be stretched to receive said paint brush holder container and then released for holding said container securely to said paint can holder container.

8. An attachment device for attaching a paint can and brush holder to a ladder wherein said ladder is the type having a pair of forward ladder legs which are slanted inwardly toward one another and between which a plurality of ladder steps are carried, said attachment device comprising:

an elongated generally vertical clamping post for supporting said paint can and brush holder;

a first bracket carried by said elongated post for attaching said paint can and brush holder thereto;

clamping means carried by said elongated post including a pair of spaced clamping members, said clamping members being offset horizontally relative to one another for clamping said elongated post to one of said slanted ladder legs so that said elongated post member is angled away from said slanted leg and is clamped in a generally vertical orientation with respect to said ladder leg which is slanted inwardly; and a cantilevered arm extending from said elongated clamping post, said first bracket being carried adjacent the end of said cantilevered arm for supporting said paint can and brush holder away from said ladder in a number of positions along the length of said ladder leg.

9. The device of claim 8 including:

said elongated clamping post having a hollow interior;

a removable insert for being carried in said hollow interior of said elongated post at an open end thereof remote from said horizontal arm;

a second bracket member carried by said removable insert which supports said paint can and brush holder.

10. The device of claim 8 including:

a paint can holder adapted for attachment to said first bracket member;

a support carried by said paint can container for supporting a removable paint brush holder; and releasable tension fastener means for securing said paint brush holder to said paint can holder when supported on said support.

11. An attachment device for attaching a paint can holder and a paint brush holder to a ladder, said ladder being of the type which includes a pair of front inwardly slanted ladder legs between which a plurality of ladder steps are carried, said attachment device comprising:

an elongated clamping post;

an angled arm carried adjacent one end of said elongated post;

a bracket carried adjacent said angle arm for attachment to a paint can holder;

a paint can holder adapted for attachment to said first bracket member;

a first clamping means attached to said elongated post having a first fixed clamping jaw for clamping said post to one of said ladder legs;

a second clamping means spaced from said first clamping means carried by said elongated clamping post for clamping said elongated clamping post to said ladder leg, said second clamping means including a second fixed clamping jaw which is laterally offset relative to said first clamping jaw with respect to said post when said elongated post is clamped to said ladder leg; and said first and second fixed clamping jaws being offset relative to each other so that said elongated post clamped thereby is clamped in a position where it is angled away from said slanted ladder leg so that said elongated post is in a generally vertical position.

12. The device of claim 11 including an abutment support carried by said paint can holder for supporting a removable paint brush holder; and a releasable fastener means for securing said paint brush holder to said paint can holder when supported thereby.

13. The device of claim 12 including a removable insert for being carried by the opposing end of said elongated post remote from said angled arm; and a second bracket means carried by said removable insert for supporting said paint can holder.

14. The device of claim 11 wherein said paint can holder includes an open top receptacle having a bottom floor and integral side walls extending up from said bottom floor.

15. The apparatus of claim 14 including an abutment support carried by said paint can holder for receiving a paint brush container; and a resilient fastening means carried by said paint can holder which is expandable to receive said paint brush holder and thereafter releasable to tensionably secure said paint brush holder to said paint can holder.

16. The device of claim 14 wherein said first and second clamping means include C-clamps having a movable jaw which clamps said ladder leg against said fixed offset jaws.

* * * * *